US007213591B2

(12) United States Patent
Nomoto et al.

(10) Patent No.: US 7,213,591 B2
(45) Date of Patent: May 8, 2007

(54) GROOVE CUTTING TOOL

(75) Inventors: Nobutoshi Nomoto, Ebina (JP); Shin Oshima, Ebina (JP); Naohisa Takahashi, Wyckoff, NJ (US)

(73) Assignees: Sankyo Diamond Industrial Co., Ltd, Ebina-shi (JP); NAO Enterprise Inc., Wyckoff, NJ (US)

( * ) Notice: Subject to any disclaimer, the term of this patent is extended or adjusted under 35 U.S.C. 154(b) by 193 days.

(21) Appl. No.: 11/047,729

(22) Filed: Feb. 2, 2005

(65) Prior Publication Data

US 2005/0191141 A1 Sep. 1, 2005

(30) Foreign Application Priority Data

Feb. 5, 2004 (JP) ..... 2004-028818

(51) Int. Cl.
*B28D 1/04* (2006.01)

(52) U.S. Cl. ..... 125/13.01; 125/15; 125/18; 451/342; 451/358

(58) Field of Classification Search ..... 125/13.01, 125/15, 18; 409/232; 451/178, 344, 342
See application file for complete search history.

(56) References Cited

U.S. PATENT DOCUMENTS 3,008,501 A * 11/1961 Hammer ..... 144/48.4
3,717,056 A * 2/1973 Gracin et al. ..... 82/82
4,505,086 A * 3/1985 Hansen ..... 52/589.1
5,303,754 A * 4/1994 Rautio ..... 144/237
5,433,563 A * 7/1995 Velepec ..... 409/234
2003/0098089 A1 5/2003 Meugniot
2005/0277377 A1* 12/2005 Nomoto et al. ..... 451/541

FOREIGN PATENT DOCUMENTS

| | | |
|---|---|---|
| FR | 2 697 463 | 5/1994 |
| JP | 6-320529 | 11/1994 |
| JP | 7-276215 | 10/1995 |
| JP | 2002-103235 | 4/2002 |

* cited by examiner

*Primary Examiner*—Timothy V. Eley
(74) *Attorney, Agent, or Firm*—Oblon, Spivak, McClelland, Maier & Neustadt, P.C.

(57) ABSTRACT

A cutting tool in which a disc-like cutter blade is fixed to a spindle of a rotary electric tool, comprising a first guide plate, which is attached on electric tool side to a cutter blade such that it is capable of rotating freely and makes contact with the reference surface of a cutting object material on a process of cutting progress so as to guide along a cutting direction, an inner flange located between the first guide plate and the cutter blade so as to specify a distance X from the reference surface of the cutting object material to a cut groove and a second guide plate which is provided on an opposite side to the electric tool side of the cutter blade and makes contact with a cut face of the cutting object material on a process of the cutting progress so as to stop moving in the cutting direction to specify a cut groove depth Y.

6 Claims, 5 Drawing Sheets

GROOVE CUTTING TOOL

TECHNICAL FIELD

The present invention relates to a groove cutting tool preferably used for forming a groove in the edge face of a stone material and the like. More particularly the present invention relates to a groove cutting tool having a guide function for cutting a groove accurately in terms of the position and cutting depth with respect to the reference plane of a slab plate in a bonding face as an accommodation space for glue when the slab plates (flat plate) of natural stone represented by granite and marble or engineered stone are bonded together through their edge faces with various kinds of glues.

BACKGROUND ART

Conventionally, various kinds of natural stones and artificial marbles (hereinafter referred to as just "stone material") are usually cut out from a slab material 20–40 mm in thickness and 1500–2000 mm long on its side as a square slab plate 70 shown in FIG. 7. When constructing as floor material or wall material on a construction site, a desired area is obtained by bonding their edges 71 together. To bond together stone materials heavy and extremely hard and brittle firmly through a side face having a small bonding area, various devices have been made. For example, as a method easy to apply on a construction site and reliable, a method in which a groove 72 is formed in the side faces to be bonded together and the side faces 71 containing the groove 72 are coated with glue 73 mainly composed of epoxy base resin, polyester base resin and the like and bonded together has been widely adopted (see FIG. 8).

According to the above-described method, by forming the groove in each of the edges faces of the stone materials to be bonded together, the bonding area can be increased and further, glues applied in two grooves merge with each other so as to obtain strict bonding condition. The adhesiveness of the glue supplements the brittleness of the bonding faces of the hard, brittle materials. Further, if the thickness of the stone materials are different, the groove under the above-described method acts as a role as a construction criterion. Thus, it is preferable that the grooves formed in the bonding faces oppose each other accurately while their depths are balanced to a specified one.

The groove for glue formed in the above-mentioned slab plate is generally formed in the width of 4–5 mm and the depth of 7–12 mm and as described above, to intensify the bonding strength, balances of the opposing position and the width and depth of the groove and the like are important factors. However as regards a groove cutting means for a stone material on a construction site, currently, a disc type cutter used for mainly cutting a stone material and the like or an offset type cutter having a concave face in the center of its substrate is employed, and individual worker works manually relying upon his experience using such a handy electric tool. If taking up an extreme example, some worker uses two pieces of diamond saw blades such that they overlap in order to obtain a width of the groove (of course, this is an illegal use), indicating that the cutting depends on the degree of skill accumulated in the worker for a long time.

Upon use, the aforementioned disc cutter or the offset cutter is attached to a handy electric tool which rotates at high speeds such as a grinder and sander. A deflection originating from vibration accompanying the rotation of the electric tool and a distortion of the substrate of the cutter provide a large disturbance on accurate cutting in a cutting object material and additionally, a large burden is born on a worker. Thus, according to an offset type cutter (for example, Japanese Patent Application Laid-Open No. 2002-103235) which has been proposed to solve the problems and used actually, in a rotary cutting tool (for example, Japanese Patent Application Laid-Open No. HEI7-276215) which absorbs vibration and deflection by interposing an elastic body between the cutter blade and spindle or an offset cutter in which a plurality of ultra abrasive layers are formed on the outer periphery of its substrate, by forming ultra abrasive layer by pressurizing at least a portion near the outer periphery of a drawn substrate with a die and sintering, distortion of the substrate is eliminated by sintering so that vibration originating therefrom is reduced.

DISCLOSURE OF THE INVENTION

Although resolution means have been taken for the vibration and eccentricity resulting in deflection in the cutter, a construction method still depends on the sensitivity and skill of an individual worker and under such a situation, it is impossible to repeat stable and accurate groove cutting. This causes reduction in yield of products and it has been demanded to make improvement in terms of work efficiency also.

Accordingly, an object of the present invention is to provide a groove cutting tool capable of cutting a groove for bonding in a stone material and the like accurately and effectively with a simple operation.

That is, the present invention provides a groove cutting tool in which a disc-like cutter blade is fixed to a spindle of a rotary electric tool by tightening a lock nut, comprising: a first guide plate which is a disc-like member to be attached to the spindle on the side of the electric tool of the cutter blade such that it is capable of rotating freely while the side face of the disc-like member makes contact with the reference surface of a cutting object material so as to guide a cutting direction; an inner flange located between the first guide plate and the cutter blade so as to specify a distance X between the reference surface of the cutting object material and the cut groove; and a second guide plate, which is a disc-like member to be attached to an opposite side of the electric tool side of the cutter blade and in which the peripheral end face of the disc-like member makes contact with the side face of the cutting object material on a process of cutting progress so as to stop a moving in the cutting direction to specify a cut groove depth Y.

Further, the present invention provides the groove cutting tool wherein the first guide plate is a disc-like member having a diameter larger than the cutter blade and containing a bearing fitting hole in the central portion and attachment thereof to the spindle of the electric tool is carried out through a bearing which is fit to the bearing fitting hole.

Further, the present invention provides the groove cutting tool wherein the second guide plate is a disc-like member having a diameter smaller than the cutter blade containing the bearing fitting hole in the central portion and the attachment thereof to the spindle of the rotary electric tool is carried out through a bearing which is fit to the bearing fitting hole.

Still further, the present invention provides the groove cutting tool wherein the first guide plate is produced of metal, resin or composite material thereof. Yet still further, the present invention provides a groove cutting tool wherein the cutting object material is a sheet material of natural stone or engineered stone.

According to the groove cutting tool of the present invention, when a groove is formed in a side face of a cutting object material, the first guide plate makes contact with a reference surface of the cutting object material at the start of the cutting and on a process of cutting progress so as to guide along the cutting direction. Thus, even a worker who is not powerful can handle an electric tool rotating at high speeds and continue the operation with the safety. The inner flange specifies a distance X from the reference surface of the cutting object material to the cut groove and the second guide plate makes contact with the side face of the cutting object material on a process of cutting progress so as to stop moving along the cutting direction to specify a cut groove depth Y and the width of the groove is determined by the width of the abrasive portion of the cutter blade. Thus, the groove for bonding can be formed in the side face of the cutting object material accurately in the position from the reference surface of the cutting object material, the width of the groove and the depth of the groove.

Especially, the first guide plate makes contact with the reference surface (for example, a top face of a stone material or the like) of the cutting object material through a flat side face on the cutter blade side so as to maintain a parallel condition between the cutter blade and the cutting object material and urges its blade tip to cut into a processing surface at right angle. Because at this time, a rotation of the spindle is offset by a bearing interposed to fit to the spindle, the operation of an electric tool is facilitated extremely. Because in the cutting operation by using the groove cutting tool of the present invention, specifying of the groove cutting position and the groove depth can be carried out easily with an extremely simple operation because of a cooperative action between the first guide plate and the second guide plate, it does not have to depend on skills of any special experienced worker and even an ordinary worker can execute accurate, stable groove cutting work effectively.

DETAILED DESCRIPTION OF THE PREFERRED EMBODIMENTS

Figure 1:
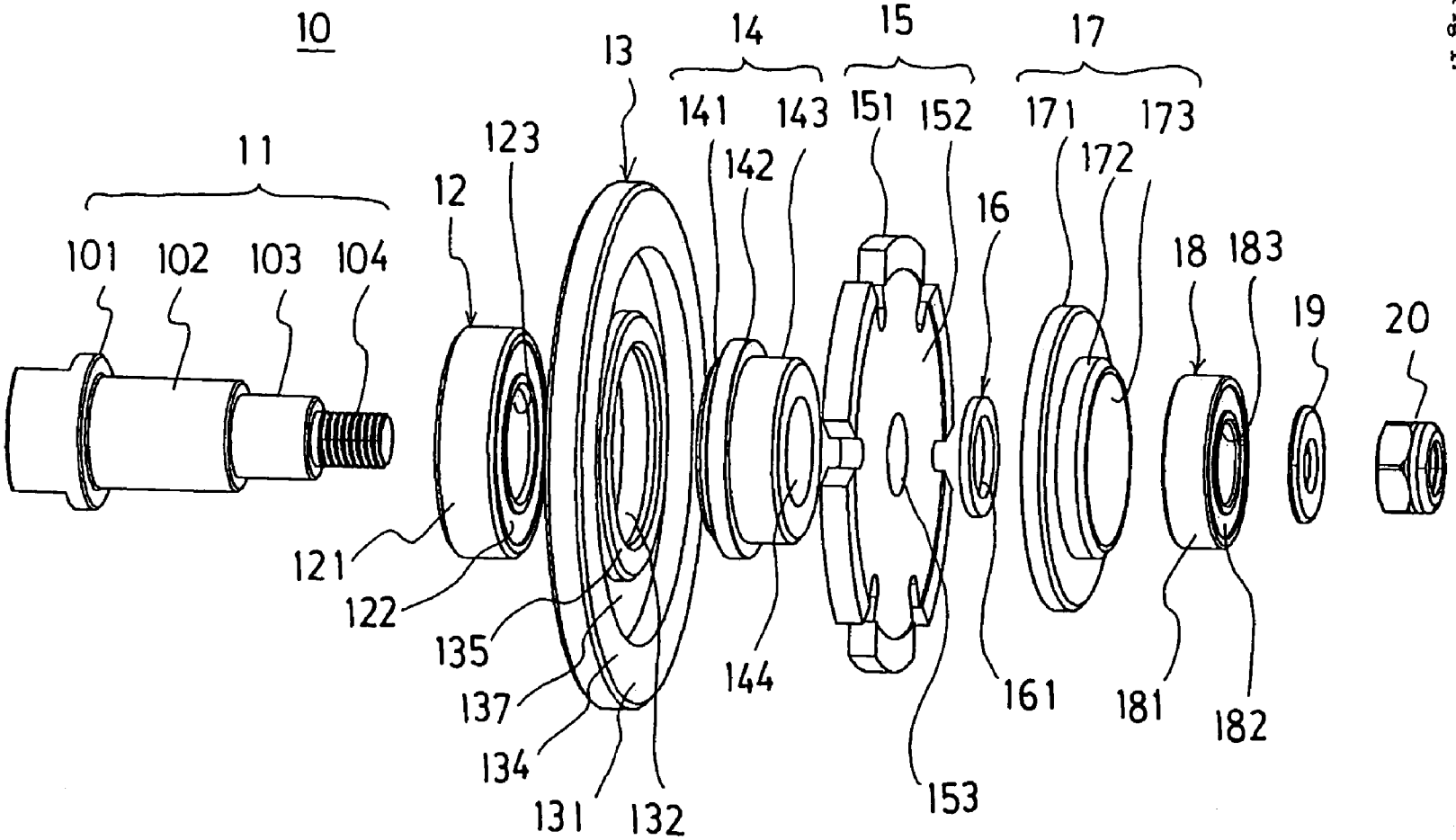
FIG. 1 is a disassembly perspective view of the groove cutting tool according to this embodiment as seen from the tip side (opposite side to an electric tool)
Figure 2:
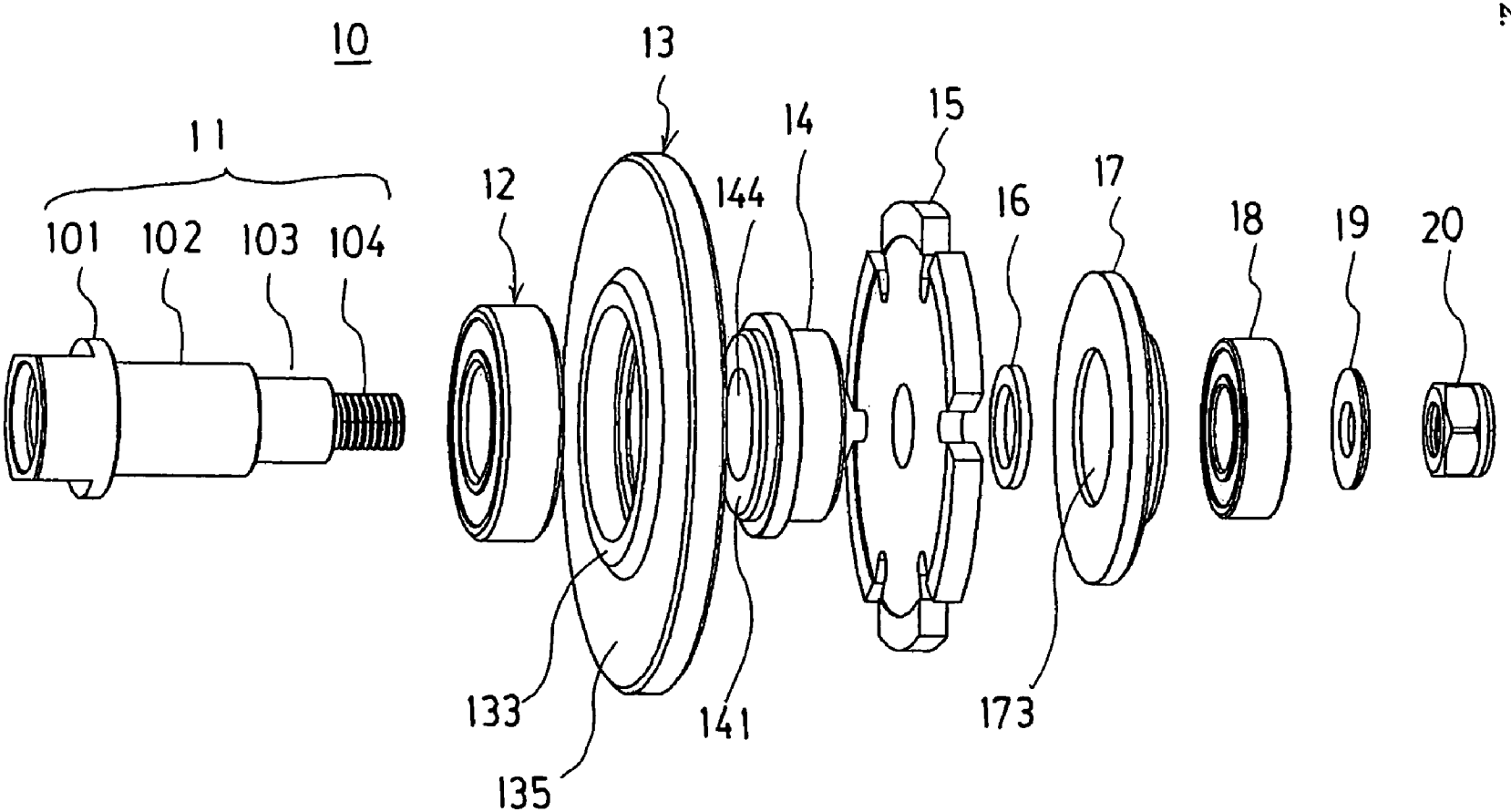
FIG. 2 is a disassembly perspective view of the groove cutting tool according to this embodiment as seen from the side of an electric tool.
Figure 3:
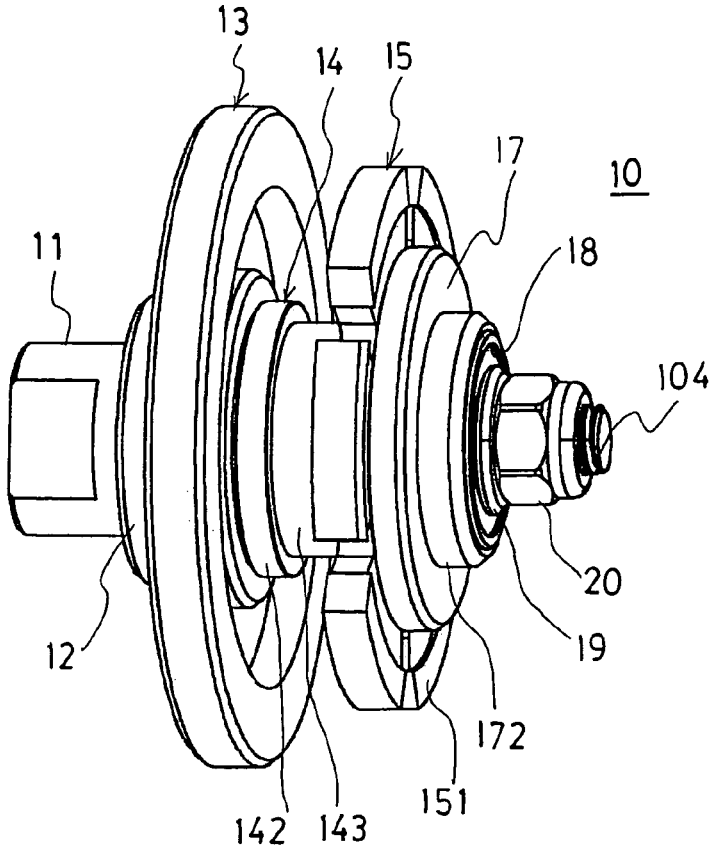
FIG. 3 is a perspective view of the groove cutting tool according to this embodiment as seen from the tip side (opposite side to the electric tool)
Figure 4:
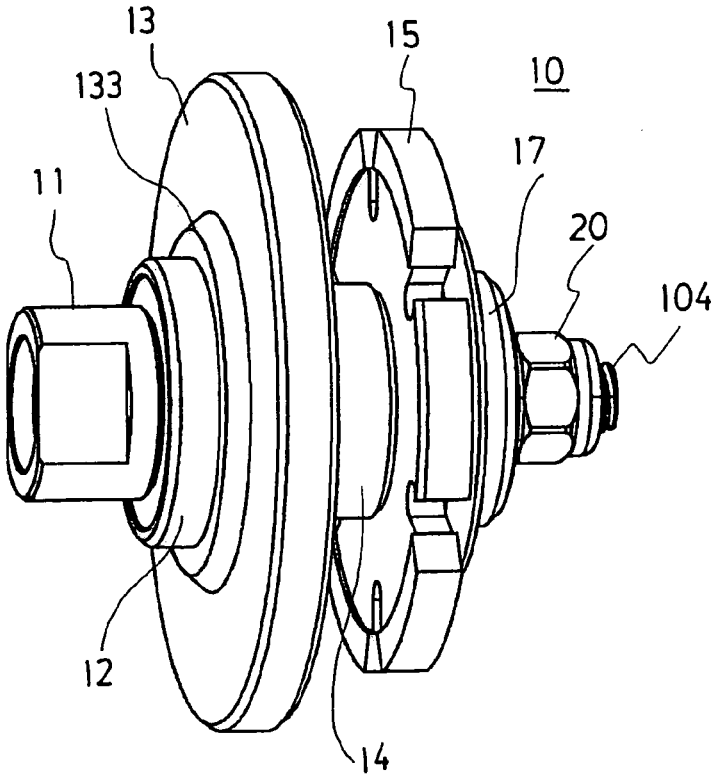
FIG. 4 is a perspective view of the groove cutting tool according to this embodiment as seen from the side of the electric tool.

Next, the groove cutting tool according to the embodiment of the present invention will be described with reference to FIGS. 1–6. In the meantime, description of the rotary electric tool is omitted in FIGS.

A groove cutting tool 10 of this embodiment is a cutting tool in which a disc type cutter blade 15 is fixed to a spindle 11 of a rotary electric tool by tightening a lock nut 20 and comprises a first guide plate 13 to be mounted on a spindle 11 on the side of the electric tool of the cutter blade 15 such that it is capable of rotating freely, an inner flange 14 located between the first guide plate 13 and the cutter blade 15 and a second guide plate 17 provided on an opposite side to the electric tool side of the cutter blade 15. As the rotary electric tool, a handy rotary electric tool such as a disc grinder, sander, and polisher can be mentioned.

The spindle 11 of the rotary electric tool of this embodiment is a spindle having a step-like configuration and comprised of a base portion 101, a first spindle main body 102 having a smaller diameter than the base portion 101, a second spindle main body 103 having a smaller diameter than the first spindle main body 102 and a male screw portion 104 having a smaller diameter than the second spindle main body 103, arranged in order from the electric tool side, such that those are integrated. The base portion 101 fixes various components sandwiched between the base portion 101 and the lock nut 20 to the spindle 11 with a tightening force of the lock nut 20. A first bearing 12 and an inner flange 14 are placed on the first spindle main body 102. A cutter blade 15, a ring-like spacer 16 and a second bearing 18 are placed on the second spindle main body 103. A lock nut 20 is engaged with the male screw portion 104. According to the present invention, the shape of the spindle 11, which is a rotary electric tool, is not restricted to this example, but it may be a single shaft having no step. In this case, the shape of a fitting hole in each component to be fit to the spindle 11 is determined to correspond to this appropriately.

The first guide plate 13 is a disc-like member which has a bearing fitting hole 132 in its central portion and a larger diameter than the cutter blade 15. At the start of cutting or during progression of the cutting process, the side face of the disc-like member makes contact with a reference surface 75 of a cutting object material 70 to guide the cutting direction (i.e. the direction of arrow a in FIG. 6 and a direction perpendicular thereto). In the first guide plate 13, a circular thick portion 135 around a bearing fitting hole 132, a circular thin portion 137 and a side face 134 on the cutter blade side form a circular thick portion 131 in order from the center to its outer periphery. The first guide plate 13 is intended to reduce its weight and intensify its strength by providing the circular thin portion 137 in the center. The bearing fitting hole 132 is formed in steps and the first bearing 12 fits to a larger diameter portion of the step. The first bearing 12 is not restricted to any particular one, and it is permissible to use a well known one comprised of an outer wheel 121, an inner wheel 123 and a ball bearing 122. An inner ring 123 of the first bearing 12 is fixed between the base portion 101 of the spindle 11 and the inner flange 14 by tightening the lock nut 20 and the outer ring 121 of the first bearing 12 fits to the bearing fitting hole 132 in the first guide plate 13, so that the first guide plate 13 is capable of rotating freely with respect to the spindle 11 of the rotary electric tool.

The material constituting the first guide plate 13 is not restricted to any particular one and for example, metal, various kinds of resins or composite materials thereof are usable. As for the metal, light metal and an alloy of magnesium, aluminum and the like are light in weight and have a specified degree of heat resistance and stiffness and excellent processability. If each resin is adopted as material constituting the first guide plate 13, it is preferable because it provides the surface of a polished sheet material with no flaw. As for the composite material, fiber-reinforced metal obtained by pouring molten metallic matrix into gaps in metallic base composite material pre-foam having porous structure and impregnating under pressure or heat resistant fiber-reinforced resin and the like can be mentioned. The thickness of the thick portion of the first guide plate 13 is not restricted to any particular one and it is designed to take into account the strength of the material and weight of the entire tool and resonance accompanied by the rotation of the tool and usually, the thickness is 5–10 mm.

The inner flange 14 is a disc type which is located between the first guide plate 13 and the cutter blade 15 and fits to the first spindle main body 102 and determines a distance X from the reference surface 75 of the cutting object material 70 and the cut groove 72. Further, as a consequence, the groove width Z of the groove 72 for bonding is specified. Although the shape of the inner flange 14 is not restricted to any particular one as long as it is sandwiched between the first bearing 12 and the cutter blade 15 so as to specify a distance X, in this example, it is provided with a jaw portion 142 at a portion near the side of the electric tool in order to prevent the first guide plate 13 from dropping in the direction of the tip. The jaw portion 142 is not limited to the above mentioned shape and if the outside diameter thereof is made equal to the outside diameter of the second guide plate 17, the jaw portion 142 can be provided with the same guide function as the second guide plate 17.

The cutter blade 15 is formed by dividing abrasive portion 151 composed of ultra abrasive layer on the outer peripheral portion of a straight disc-like steel substrate 152 into a plurality of sections via U groove or key groove. The abrasive portion 151 of the cutter blade 15 is not limited to such a segment type but a rim type in which the entire abrasive portion is formed continuously on the outer peripheral portion of the steel substrate is permitted. Further, the width (thickness) of the abrasive portion 151 is set to the same dimension as the width of a cut groove from viewpoint of cutting a groove for use for bonding in a stone slab plate 70. On the other hand, the thickness of the disc-like steel substrate 152 is made smaller than the thickness of the abrasive portion 151 so as to reduce cutting resistance.

The second guide plate 17 is a circular member having a smaller diameter than the cutter blade 15, installed on an opposite side to the electric tool side of the cutter blade 15 and on a process of cutting progress, the peripheral end face 173 of the circular member makes contact with a side face 71 of the cutting object material 70 so as to stop a moving in the cutting direction (arrow a) to specify a cutting depth Y. In the second guide plate 17, a thick portion 172 around the bearing fitting hole 173 and a thin portion main body 171 are formed in order from the center to the outer periphery. The bearing fitting hole 173 is formed in a step-like form and the second bearing 18 is fit to its large diameter portion of the step and the ring-like spacer 16 is interposed in a gap between the second bearing 18 and the steel substrate 152 of the cutter blade. As the second bearing 18, the one having the same structure as the first bearing 12 can be used. An inner ring 183 of the second bearing 18 is fixed between the ring-like spacer 16 and a washer 19 by tightening the locknut 20. Further, because an outer ring 181 of the second bearing 18 is fit to the bearing fitting hole 173 in the second guide plate 17, the second guide plate 17 is permitted to be freely rotatable around the spindle 11 of the rotary electric tool. The second guide plate 17 is not limited to this example, but it may be fixed to the spindle 11 not through any bearing. In this case, although a slight deflection occurs due to a contact between the side face 71 of the cutting object material 70 and the peripheral end face 173 of the thin portion main body 171 of the second guide plate, it hardly affects cutting work.

Figure 5:
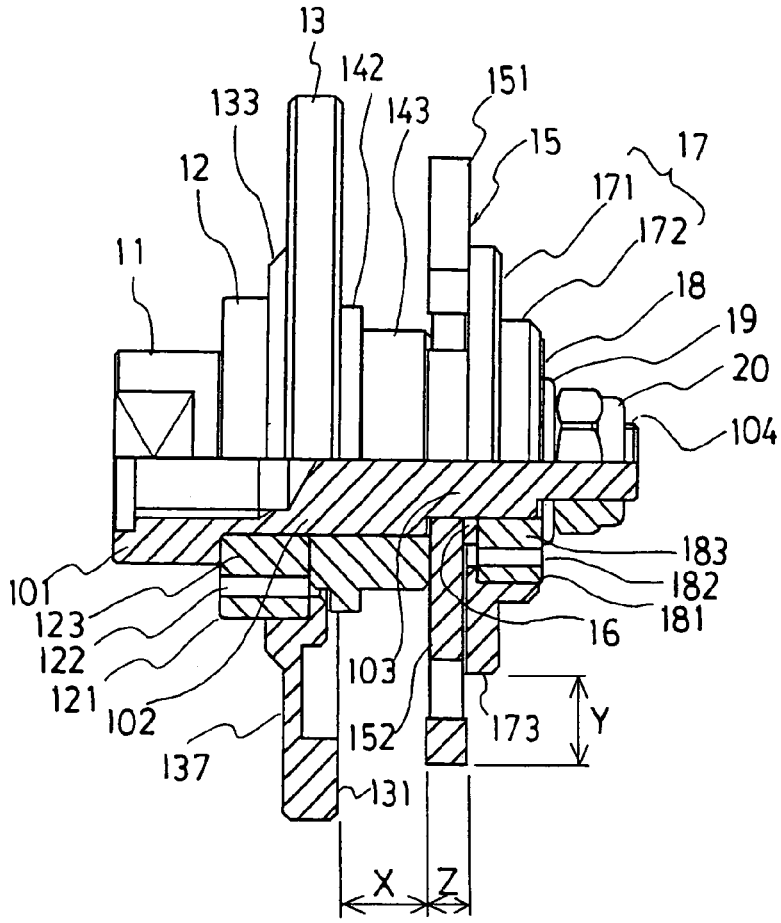
FIG. 5 is a partially sectional side view showing the groove cutting tool according to this embodiment.

As for an assembly method of the groove cutting tool 10 of this embodiment, the components are mounted on the spindle 11 of the rotary electric tool in the order of those arranged in FIG. 1. In the groove cutting tool 10 after assembly, as shown in FIG. 5, the inner ring 123 of the first bearing 12, the inner flange 14, the steel substrate 152 of the cutter blade 15, the ring-like spacer 16, the inner ring 183 of the second bearing 18 and the washer 19 are fixed between the lock nut 20 and the base portion 101 of the spindle 11 in order from the side of the electric tool. Therefore, the cutter blade 15 is rotated with a rotation of the spindle 11 of the electric tool while the first guide plate 13 and the second guide plate 17 are prevented from idling or rotating. Further, the dimension between the first guide plate 13 and the cutter blade 15 is equal to a distance X from the reference surface of the cutting object material to the groove and a difference in dimension between the tip of the cutter blade 15 and the tip of the second guide plate 17 is equal to a groove depth Y.

An example of forming the groove 72 for bonding in the side face 71 of the cutting object material 70 using the groove cutting tool 10 of this embodiment is shown here. As the cutting object material 70, a slab plate (sheet material) of natural stone such as granite, marble or artificial marble can be mentioned. Although usually, the reference surface 75 of the cutting object material is a top face (front surface), if the groove 72 is formed in the center of the side face 71 of the cutting object material 70, it may be either the top face or the bottom face. First, the cutting object material 70 is fixed with a fixing means (not shown). With a switch of the electric tool ON, the flat side face 131 of the first guide plate 13 is brought into a contact with the reference surface 75 (top face in FIG. 6) of the cutting object material so as to determine the positional relation between the cutting object material and the rotary electric tool. Next, cutting is carried out with the side face 131 of the first guide plate 13 and the cutting direction (arrow a in Figure) kept in parallel to each other. Because at this time, the first guide plate 13 is static on the reference surface of the cutting object material, not affected by a rotation of the spindle 11, the cutter blade 15 can be maintained to always keep a constant position in the cutting direction. Then, because on a process in which the cutting is progressed in the direction of groove depth, the peripheral end face 173 of the thin portion main body 171 of the second guide plate 17 makes contact with the side face 71 of the cutting object material, a progress of the cutter blade 15 in the direction of the groove depth is stopped. On the other hand, cutting along a side face (arrow b in FIG. 7) in a direction perpendicular to the direction of the groove depth may be executed from an end side 74 of the cutting object material 70 to the other end side 76. According to the cutting work of this example, the depth of the groove 72 can be controlled easily to a constant one (Y) without any special operation, so that accurate, stable groove cutting can be executed repeatedly. Further, even if the second guide plate 17 makes contact with the side face 71 of the cutting object material, it is not affected by a rotation of the spindle 11 and kept static to facilitate the cutting without any deflection.

EXAMPLE 1

Figure 6:
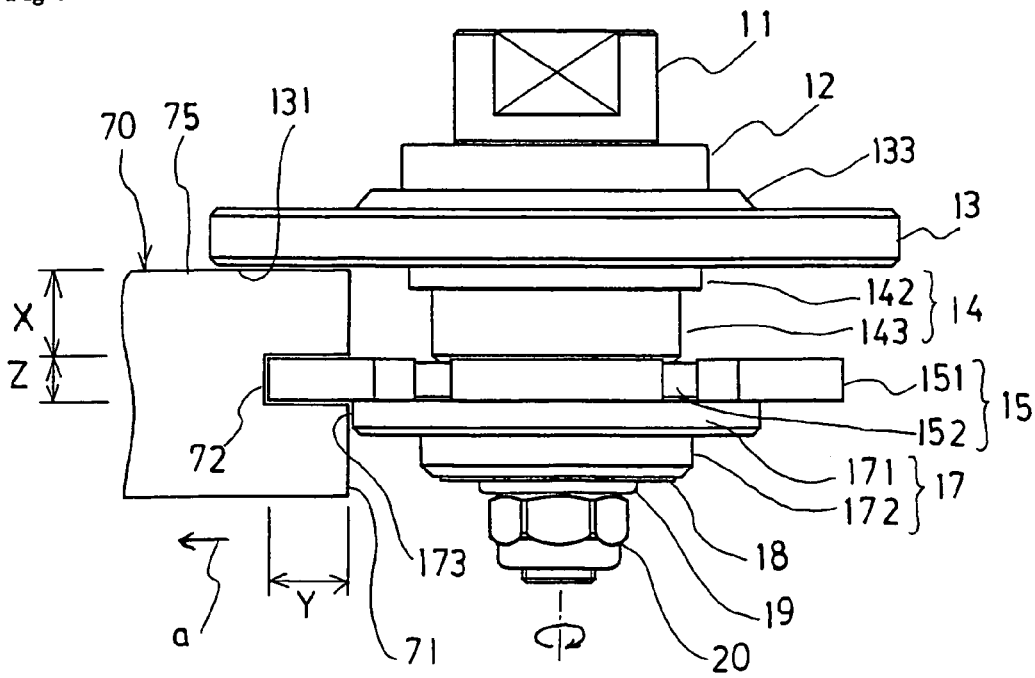
FIG. 6 is a diagram showing the positional relation between the groove cutting tool of this embodiment and a cutting object material.
Figure 7:
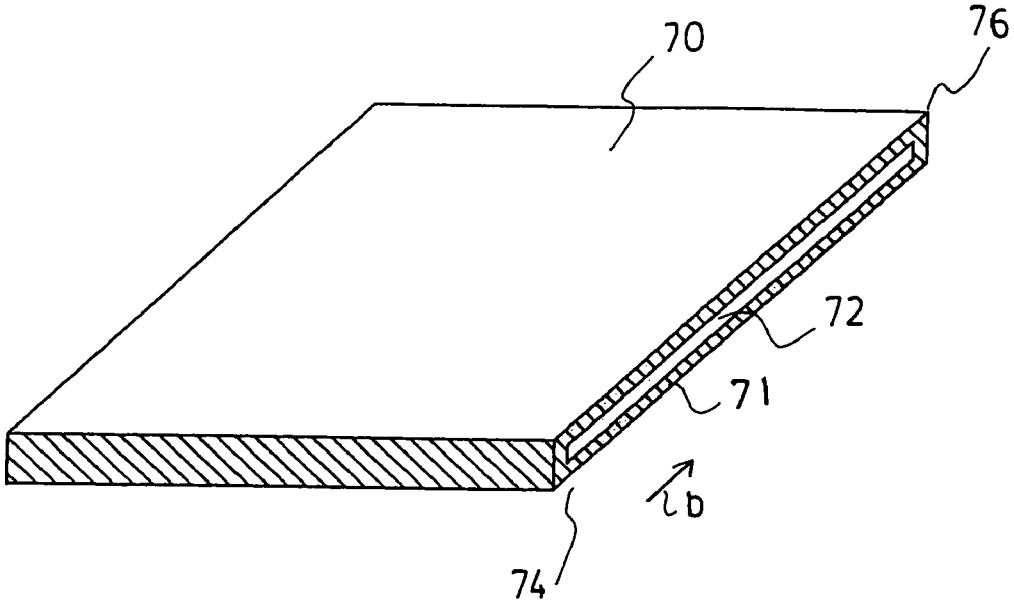
FIG. 7 is a diagram showing a cutting object material and a bonding groove formed in a side face of the cutting object material.

In construction work for a counter top with natural granites 400 mm vertical, 1000 mm horizontal and 30 mm thickness, the groove 72 for bonding as shown in FIG. 7 was formed to bond together plural pieces of the slab plates 70 made of the granite. As a groove cutting tool for cutting the groove 72, the groove cutting tool shown in FIGS. 1–6 was used. First, an acrylic resin guide (first guide plate) 13 having the outside diameter of 96.2 mm and the thickness of 7.5 mm in which the first bearing 12 is fit to the bearing fitting hole 132, the circular inner flange 14 having the entire width of 16.75 mm, the cutter blade 5 having the outside diameter of 80 mm, in which the thickness of the steel substrate 152 is 4.5 mm and the thickness of the abrasive portion 151 is 6.5 mm, the ring-like spacer 16 having the thickness of 2.0 mm, and the outer flange (second guide plate) 17 having the entire width of 4.0 mm (entire width of the thin portion main body 171) and the outside diameter of 56 mm in which the second bearing 18 is fit to the bearing fitting hole 173, were placed on the spindle 11 of a disc grinder (not shown) in order and finally, the lock nut 7 was tightened.

When forming the groove 72 for bonding the slab plates 70 using the groove cutting tool 10 obtained in the above-described way, the side face 131 of the first guide plate 13 was brought into contact with the top face 75 of the slab plate 70 as shown in FIG. 6 and while confirming that the abrasive portion 151 of the cutter blade 15 kept contact with the cut face 71 at the right angle, the disc grinder was rotated to cut the groove. The abrasive portion 151 of the cutter blade 15 was guided to the central portion on the bonding side face of the slab plate 10 by the first guide plate 13 and spacer function of the inner flange 14 and the depth of the groove was specified to 12 mm by stopper action of the outer flange (second guide plate) 17. Consequently, a slab plate 70 in which the groove 72 for bonding was formed accurately was obtained as shown in FIG. 7.

Figure 8:
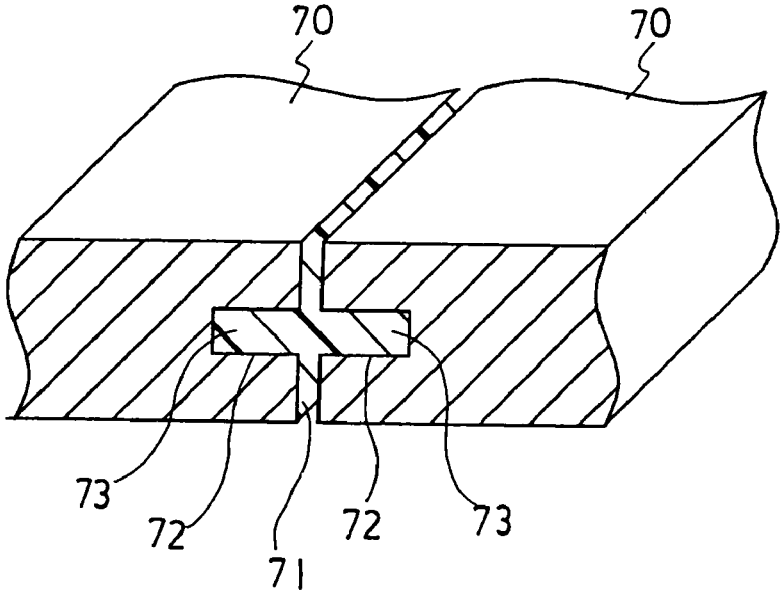
FIG. 8 is an enlarged perspective view showing the bonding portions of two cutting object material broken partially.

Epoxy base glue ("brand name Akemi2010"; made by Akemi) 73 was applied to the side faces 71, 71 including the grooves 72, 72 formed in the bonding side faces of the slab plates 70, 70 obtained according to the example 1 and the coated faces were abutted and bonded together. Consequently, the both grooves 72, 72 opposed each other in good balance as shown in FIG. 8 and it was confirmed that the slab plates 70, 70 were bonded together stably.

EXAMPLE 2

The groove cutting tool was constructed in the same way as the example 1 except that the outer flange (second guide plate) 17 was fit to the spindle 11 via a spacer having the same configuration as the second bearing without interposing the second bearing and the same groove cutting processing as the example 1 was carried out on the slab plate. That is, this example concerns a configuration in which the outer flange (second guide plate) 17 is fixed to the spindle 11. As a result, it was confirmed that accurate grooves 72, 72 were efficiently formed substantially in the same way as the example 1 despite a slight deflection and in side face bonding test using the same glue as the example 1, an excellent bonding condition equal to the example 1 was verified.

INDUSTRIAL APPLICABILITY

Despite a simple structure in which disc-like first guide plate and second guide plate are attached to a conventional cutting tool for stone material and the like, it is confirmed that the groove cutting tool of the present invention described in detail above functions extremely effectively so as to cut a groove for bonding to be formed in the bonding side face such that it opposes a groove in another side face when slab plates of various kinds of stone materials are bonded together accurately and in good balance in cutting position, groove width, groove depth and the like. Further, any experienced worker having a special high skill is not necessary for cutting work on a construction site and any worker trained through a specified training course can execute stable groove cutting work efficiently and relatively easily. Additionally, because the groove cutting tool of the present invention can be operated under conditions in which the first guide plate is placed on the reference surface of the cutting object material, even a worker who is not powerful can handle an electric tool rotating at high speeds easily and continue the operation with safety.

The invention claimed is:

1. A groove cutting tool in which a disc-like cutter blade is fixed to a spindle of a rotary electric tool by tightening a lock nut, comprising:

a first guide plate which is a disc-like member to be attached to the spindle on the side of the electric tool of the cutter blade such that it is capable of rotating freely while the side face of the disc-like member makes contact with a reference surface of a cutting object so as to guide a cutting direction;

an inner flange located between the first guide plate and the cutter blade so as to specify a distance X between the reference surface of the cutting object and a groove cut in the cutting object; and a second guide plate, which comprises a disc-like member to be attached to a side of the cutter blade opposite said inner flange, wherein a peripheral end face of the disc-like member contacts a side face of the cutting object so as to stop movement in the cutting direction to specify a cut groove depth Y wherein a bearing is positioned between said cutter blade and the spindle and wherein said first guide plate comprises a disc-like member having a diameter larger than the cutter blade and having a bearing fitting hole located in a central portion thereof, said bearing being fitted into said bearing fitting hole.

2. The groove cutting tool according to claim 1 wherein said second guide plate comprises a disc-like member having a diameter smaller than the cutter blade and containing a bearing fitting hole in a central portion thereof wherein attachment thereof to the spindle of the rotary electric tool is carried out through a bearing which is fitted to the bearing fitting hole of said second guide plate.

3. The groove cutting tool according to claim 1 which comprises a first spindle main body wherein said inner flange comprises a circular flange which is fitted to said first spindle main body.

4. The groove cutting tool according to claim 1 wherein said cutter blade is formed of an abrasive portion comprising an abrasive layer on the outer peripheral portion of a disk-like steel substrate having a plurality of sections having a U-shaped groove or key-shaped groove.

5. The groove cutting tool according to claim 1 wherein said first guide plate comprises one of a metal a resin or composite material thereof.

6. The groove cutting tool according to claim 1 wherein said cutting object comprises a sheet material of natural stone or engineered stone.

* * * * *